United States Patent [19]

Perez et al.

[11] 4,280,335

[45] Jul. 28, 1981

[54] ICEBANK REFRIGERATING AND COOLING SYSTEMS FOR SUPERMARKETS

[75] Inventors: Arthur Perez, Buchanan; Fayez F. Abraham, Niles, both of Mich.

[73] Assignee: Tyler Refrigeration Corporation, Niles, Mich.

[21] Appl. No.: 47,870

[22] Filed: Jun. 12, 1979

[51] Int. Cl.[3] ..... F25B 25/00

[52] U.S. Cl. ..... 62/332; 62/435; 62/441

[58] Field of Search ..... 62/59, 435, 332, 340, 62/441, 118; 237/63

[56] References Cited

U.S. PATENT DOCUMENTS

| | | | |
|---|---|---|---|
| 240,396 | 4/1881 | Dusenbury | 62/340 |
| 1,969,187 | 8/1934 | Schutt | 62/59 X |
| 2,027,058 | 1/1936 | Neeson | 62/59 |
| 2,688,849 | 9/1954 | Andrews | 62/506 X |
| 2,737,027 | 3/1956 | Kleist | 62/59 X |
| 2,808,494 | 10/1957 | Telkes | 236/10 X |
| 2,962,218 | 11/1960 | Dibert | 126/110 R X |
| 3,024,008 | 3/1962 | Blum | 62/435 X |
| 3,906,742 | 9/1975 | Newton | 62/332 |
| 4,003,214 | 1/1977 | Schumacher | 62/340 |

*Primary Examiner*—William E. Tapolcai, Jr.
*Attorney, Agent, or Firm*—LeBlanc, Nolan, Shur & Nies

[57] ABSTRACT

An icebank system is provided for refrigerating produce areas and providing air conditioning in supermarkets. The system is adapted to handle all refrigerating and cooling requirements of supermarkets including produce cases, beverage coolers, food preparation areas, and air conditioning. The icebank system allows a supply of ice to be built up in an icebank storage tank in off-peak hours when the cost of electrical power is lowest. Cold water is circulated from the icebank storage tank to the various produce areas where cooling is required. Each produce area is provided with a heat exchanger which receives cold water from the icebank storage tank to maintain a low refrigeration temperature in the produce area. Each produce area is tapped into a main water conduit extending from the icebank storage tank. The spent water from each produce area is returned to the icebank storage tank via a return conduit. The spent water is still sufficiently cold to be used to maintain a low condensing temperature in a conventional refrigeration unit. The cold water from the icebank storage tank is also supplied to an air conditioning unit to cool the ambient air in the supermarket.

10 Claims, 3 Drawing Figures

ICEBANK REFRIGERATING AND COOLING SYSTEMS FOR SUPERMARKETS

BACKGROUND OF THE INVENTION

The present invention relates to icebank refrigerating and cooling systems for supermarkets. Specifically, this invention relates to a multi-function icebank refrigerating and cooling system which can be utilized to perform all cooling functions required in the operation of a supermarket. The invention enables a single system to provide refrigeration for the produce cases, coolers, and processing rooms as well as to provide air conditioning for the supermarket. By using an icebank, the system can be economically operated at off-peak hours to build up a supply of ice which is consumed in the peak hours to provide the desired refrigerating and cooling operations.

Icebank cooling systems are known in the prior art. Typically, in the operation of an icebank system, a supply of ice is gradually built up and stored in a storage tank from which cold water is circulated to a cooling device, e.g., an air conditioning unit or refrigerating unit, when it is desired to perform cooling operations. The icebank system allows the supply of ice to be economically made at off-peak hours, usually late evening and early morning hours, when the demand for electrical power is lowest and the price is reduced to encourage more evenly distributed power consumption. Typically, the off-peak rate may be only one-half of the peak rate for electricity. Thus, by using electricity to produce the ice supply in off-peak hours for later consumption at peak hours, it is possible to achieve considerable savings in the cost of operation of a cooling system.

Previous proposals for utilizing icebank systems have included church installations and other similar facilities where the actual time of usage is relatively small in comparison with the large amount of time available to build up the supply of ice. See, for example, U.S. Pat. No. 3,653,221. It has also been proposed to utilize icebank systems to provide bulk milk cooling apparatus. See, for example, U.S. Pat. Nos. 3,271,968; 3,448,589; and 3,456,452. However, such cooling apparatus has not experienced widespread use because the small-scale nature of the operation does not usually warrant the financial investment in such apparatus. None of these references contemplated the type of large-scale, multi-function cooling operations required in supermarkets and other similar facilities.

The present invention recognizes the significant advantages achieved by utilizing an icebank system for large-scale refrigerating and cooling operations. It has been appreciated that a supermarket, with its numerous refrigerating and cooling requirements, presents an environment uniquely suited to take advantage of the benefits of an icebank system. The typical supermarket includes produce cases maintained at low temperatures to preserve fresh fruits and vegetables, frozen food counters maintained at temperatures at or below freezing to preserve frozen items such as meat, fish, fruits, vegetables and juices, coolers which store beverages, milk and dairy products at low temperatures, meat counters and processing rooms where meat and other items are prepared and packaged for sale. All these areas represent substantial cooling loads with significant power requirements. Moreover, the air conditioning of the supermarket represents an additional cooling load. Previously, each produce area has been provided with its own individual cooling unit separate from the main air conditioning system in the supermarket. The present invention advantageously provides a single icebank system which is capable of meeting all refrigerating and cooling requirements in a supermarket.

SUMMARY OF THE INVENTION

In accordance with the invention, an icebank system for refrigerating produce areas and providing air conditioning in a supermarket comprises means for producing a supply of ice, an icebank storage tank for storing the ice, means for circulating cold water from the icebank storage tank to the produce areas, heat exchange means at each produce area coupled to the water circulating means for receiving the circulating cold water to cool the produce area, and air cooling means coupled to the water circulating means for receiving the circulating cold water to cool the ambient air in the supermarket. The use of an icebank storage tank allows the supply of ice to be produced most efficiently at off-peak times when utility rates are lowest. The icebank conveniently allows the ice to be built up in the late evening and early morning hours, when the supermarket is closed, and to be consumed during normal business hours to provide the necessary refrigerating and cooling in the supermarket.

Preferably, the ice is produced by a mechanical icemaker which deposits the supply of ice into the icebank storage tank. Alternatively, an immersion type ice maker can be employed to freeze the water in the icebank storage tank. In addition, a cooling circuit may be provided for circulating a fluid between an outdoor heat exchanger at a temperature below freezing and the icebank storage tank to form ice therein. This arrangement is particularly advantageous for use in cold climates where the outdoor temperature is sufficiently low to produce ice in the storage tank by merely circulating a low temperature fluid, e.g., brine, from the outdoor heat exchanger to an ice forming device located above or immersed in the icebank storage tank.

A preferred embodiment of the icebank system includes a refrigeration unit having a condenser through which a refrigerant is circulated. The cold water from the icebank storage tank is conveyed across the condenser to cool the refrigerant and utilize the lowest possible condensing temperature to enhance the efficiency of the operation. The refrigeration unit preferably includes a supplementary outdoor condenser operable when the outdoor temperature is sufficiently low to maintain a low condensing temperature and cool the refrigerant. This arrangement is particularly useful in cold climates where the outdoor temperature itself is low enough to cool the refrigerant without the need to consume the ice in the icebank storage tank.

The utilization of an icebank refrigerating and cooling system in a supermarket results in definite advantages. When an icebank system is used for air conditioning, it provides a steady state temperature of the cooling medium and produces a more controlled cooling effect on the ambient air. The steady state condition produces the lowest practical cooling temperature which allows the air conditioning system to work more effectively on the latent load of the building. When the icebank system is used with refrigerators which operate at or near 40° F., the desired cooling is accomplished without having to apply the work of freezing the moisture from the air on the heat exchange surface. Moreover, since frost does not occur under these circumstances, defrosting is not required and, as a result, steady state conditions are produced in the refrigerator which are most conducive to the preservation of fresh produce.

Another important aspect of the icebank system is its air conditioning feature which supplements the main air flow with precooled and dehumidified make-up air to control the humidity within the supermarket. To properly air condition a building, two cooling requirements must be satisfied: (1) cooling the ambient air to a controlled temperature, and (2) removing moisture from the air. Conventional air conditioning units usually do not separate these two requirements. Thus, these units normally handle the cooling requirement satisfactorily but do not properly control moisture removal. The icebank system of the present invention overcomes this disadvantage by pre-cooling the make-up air which is thereby sufficiently dehumidified to control the humidity.

In accordance with a preferred feature of the invention, the air cooling means comprises a heat exchanger coupled to the water circulating means for receiving cold water from the icebank storage tank, a blower for passing air over the heat exchanger to be cooled, an air outlet and a return located on opposite sides of the blower providing communication with the ambient air in the supermarket, and means for supplying make-up air to the return side of the blower to mix with the ambient air and control the humidity in the supermarket. Preferably, a second heat exchanger is coupled to the water circulating means for receiving cold water from the icebank storage tank to cool the make-up air prior to its mixture with the ambient air. The heat exchangers advantageously provide heat exchange surfaces in contact with the ambient air and the make-up air which are substantially at the freezing level of 32° F. to efficiently cool both. As a result, the make-up air is pre-cooled and dehumidified prior to its mixture with the ambient air.

Another advantageous feature of the icebank system is a conduit arrangement wherein a main water supply conduit extends from the icebank storage tank to appropriate places within the supermarket where a tap-in connection is provided at each produce area for supplying cold water from the main water supply conduit to the heat exchange means in the produce area. A main pump is provided for pumping cold water from the icebank storage tank through the main water supply conduit, and separate pumps are provided at each produce area for pumping the cold water from the main water supply conduit through each heat exchange means. As a result, the main pump requirements are determined by the resistance to flow in the main water supply conduit alone, while each refrigeration or cooling unit has an individual pump to handle its own requirements.

Accordingly, it is an object of this invention to provide a multi-function icebank cooling system for use in large-scale installations such as supermarkets to handle all refrigeration and cooling requirements.

It is also an object of the invention to provide an improved icebank system for efficiently and economically refrigerating produce areas and providing air conditioning in supermarkets.

Another object of the invention is to provide an icebank refrigerating and cooling system which takes advantage of low outdoor temperatures in cold climates to enhance its operating efficiency.

DESCRIPTION OF THE PREFERRED EMBODIMENT

Figure 1:
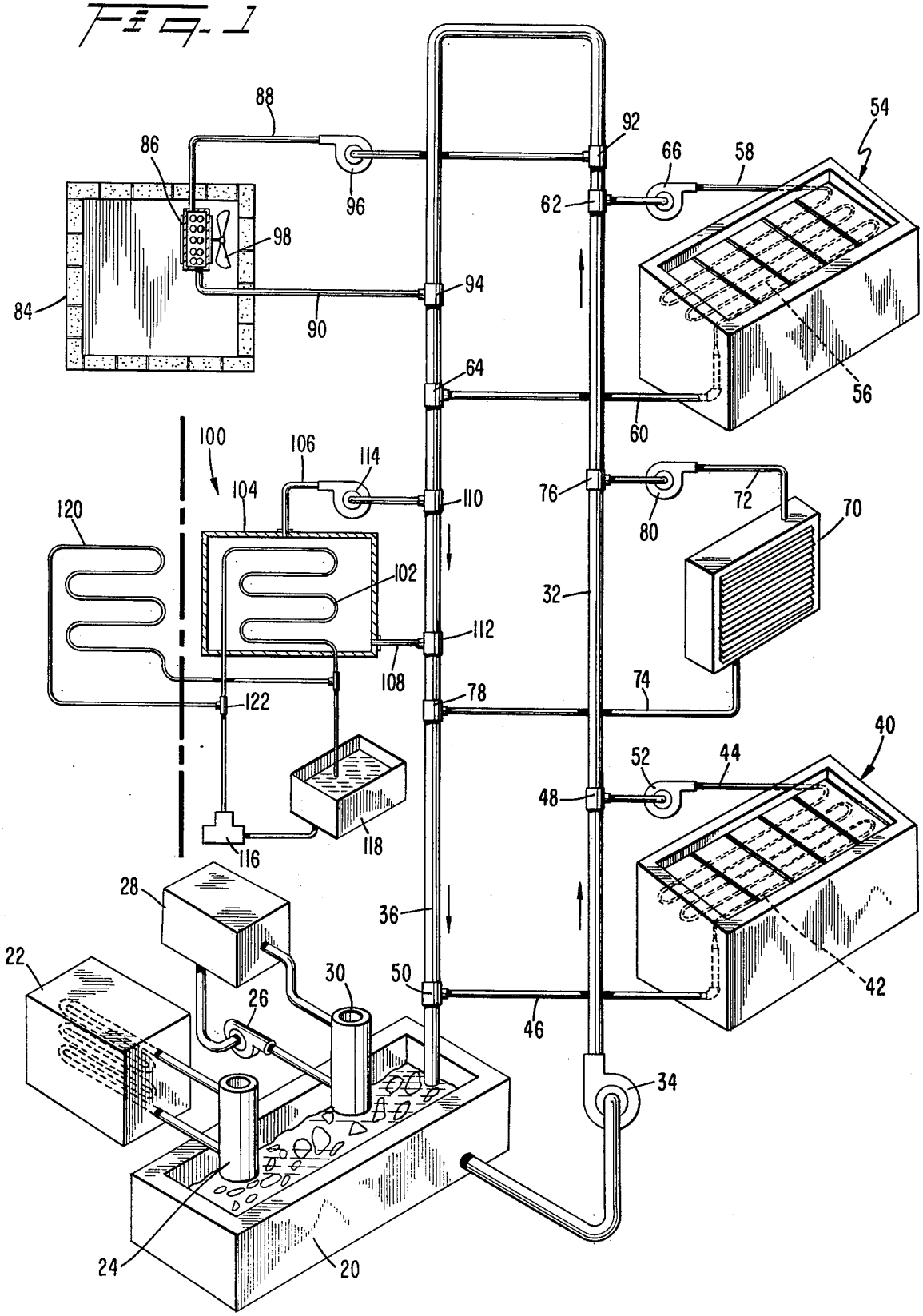
FIG. 1 is an overall schematic view of an icebank system embodying the present invention for refrigerating produce areas and providing air conditioning in a supermarket.

Referring to FIG. 1, an icebank refrigerating and cooling system for a supermarket includes an icebank storage tank 20 for storing a supply of ice produced by a mechanical icemaker 22. The mechanical icemaker includes a conventional refrigeration circuit which produces temperatures below freezing to form ice on a cylindrical ice forming head 24 from which it is deposited into a cold water bath contained in icebank storage tank 20. Alternatively, an immersion type mechanical icemaker can be employed with coils immersed in the water to form ice directly in the icebank storage tank. In addition, a supplementary cooling circuit comprising a pump 26, an outdoor heat exchanger 28, and a cylindrical ice forming head 30 may be provided to take advantage of low outdoor temperatures in cold climates to form ice. Preferably, the cooling circuit circulates a coolant, e.g., brine, having a freezing temperature below 32° F. The brine is cooled at heat exchanger 28 to a temperature below the freezing point of water and is circulated by pump 26 to head 30 where ice is formed and dropped into icebank storage tank 20. Alternatively, an immersion coil may be used in place of head 30 to form ice directly in the icebank storage tank.

To minimize the cost of ice production, the supply of ice is gradually built up and stored in icebank storage tank 20 by operating mechanical icemaker 22 in off-peak hours when the cost of electrical power is lowest. Thereafter, during normal business hours, the ice is consumed to provide the desired refrigerating and cooling operations in the supermarket. The supplementary outdoor cooling circuit allows ice to be produced inexpensively, when the outdoor temperature is below the freezing point, for merely the cost of operating pump 26 to circulate the coolant through the circuit.

A main water supply conduit 32 extends from icebank storage tank 20 to the various produce areas in the supermarket where cooling is required. A water pump 34 is provided for pumping cold water from icebank storage tank 20 through main water supply conduit 32. A return conduit 36 completes the main water circulation circuit and allows the cold water circulated to the various produce areas to return to icebank storage tank 20 to be cooled and recirculated.

A fresh produce case 40 located at a first produce area includes a heat exchanger 42 coupled to main water supply conduit 32 and return conduit 36 via inlet and outlet lines 44 and 46, respectively. A pair of tap-in connections 48 and 50 is provided to allow inlet and outlet lines 44 and 46 to be conveniently coupled to water supply conduit 32 and return conduit 36. A separate pump 52 is located in input line 44 to pump cold water from water supply conduit 32 through heat exchanger 42. The heat exchanger functions to absorb heat at the open top portion of the produce case to maintain a low refrigeration temperature for storage of fresh produce, e.g. fruits and vegetables.

Similarly, a dairy produce case 54 located at a second produce area includes a heat exchanger 56 coupled to the main water circulation circuit by a pair of inlet and outlet lines 58 and 60, respectively. A pair of tap-in connections 62 and 64 allow input and output lines 58 and 60, respectively, to be tapped into main water supply conduit 32 and return conduit 36. A separate pump 66 is located in input line 58 to pump cold water from main water conduit 32 through the heat exchanger 56 which absorbs heat at the open top portion of the produce case to refrigerate dairy products.

The icebank system also utilizes the cold water circulated through main water supply conduit 32 to air condition the supermarket. An air conditioning unit 70 is coupled to main water supply conduit 32 and return conduit 36 via input and output lines 72 and 74, respectively, and a corresponding pair of tap-in connections 76 and 78. A separate pump 80 is located in input line 72 to pump cold water from main water supply conduit 32 through a heat exchanger in air conditioning unit 70. The air conditioning unit is described in more detail below.

A preparation room or cooler 84, e.g., a case for soda, beer and other beverages, located at a third produce area includes a heat exchanger 86 coupled to main water supply conduit 32 and return conduit 36 via input and output lines 88 and 90, respectively, and a pair of corresponding tap-in connections 92 and 94. A separate pump 96 is located in input line 88 to pump cold water from main water supply conduit 32 through heat exchanger 86. A fan 98 is provided adjacent to heat exchanger 86 to circulate the air within preparation room or cooler 84 across the heat exchanger to maintain a low storage temperature therein.

The icebank system is also adapted to be used with conventional refrigeration units to maintain low condensing temperatures in such units. For example, a refrigeration unit, generally 100, includes a condenser 102 located within a water jacket 104 coupled to return conduit 36 via input and output lines 106 and 108, respectively, and a pair of corresponding tap-in connections 110 and 112. A separate pump 114 is provided in input line 106 to pump cold water from return conduit 36 through water jacket 104 and over condenser 102. The condenser forms part of a conventional refrigeration circuit including a compressor 116 and an evaporator 118 through which a refrigerant is circulated. The cold water circulated through water jacket 104 over condenser 102 serves to cool the refrigerant in the condenser to maintain a low condensing temperature and enhance the efficiency of its operation. Refrigeration unit 100 also includes an outdoor condenser 120 coupled to compressor 116 via a three-way control valve 122. Outdoor condenser 120 is operable in place of condenser 102 when the outdoor temperature is sufficiently low to cool the refrigerant therein. When outdoor condenser 120 is operating, water cooled condenser 102 and pump 114 may be shut off, thereby reducing the drain on (and thereby the workload of) the icebank reserve. As a result, outdoor condenser 120 allows the system to take advantage of the low outdoor temperatures in cold climates to enhance the overall operating efficiency of the system.

Figure 2:
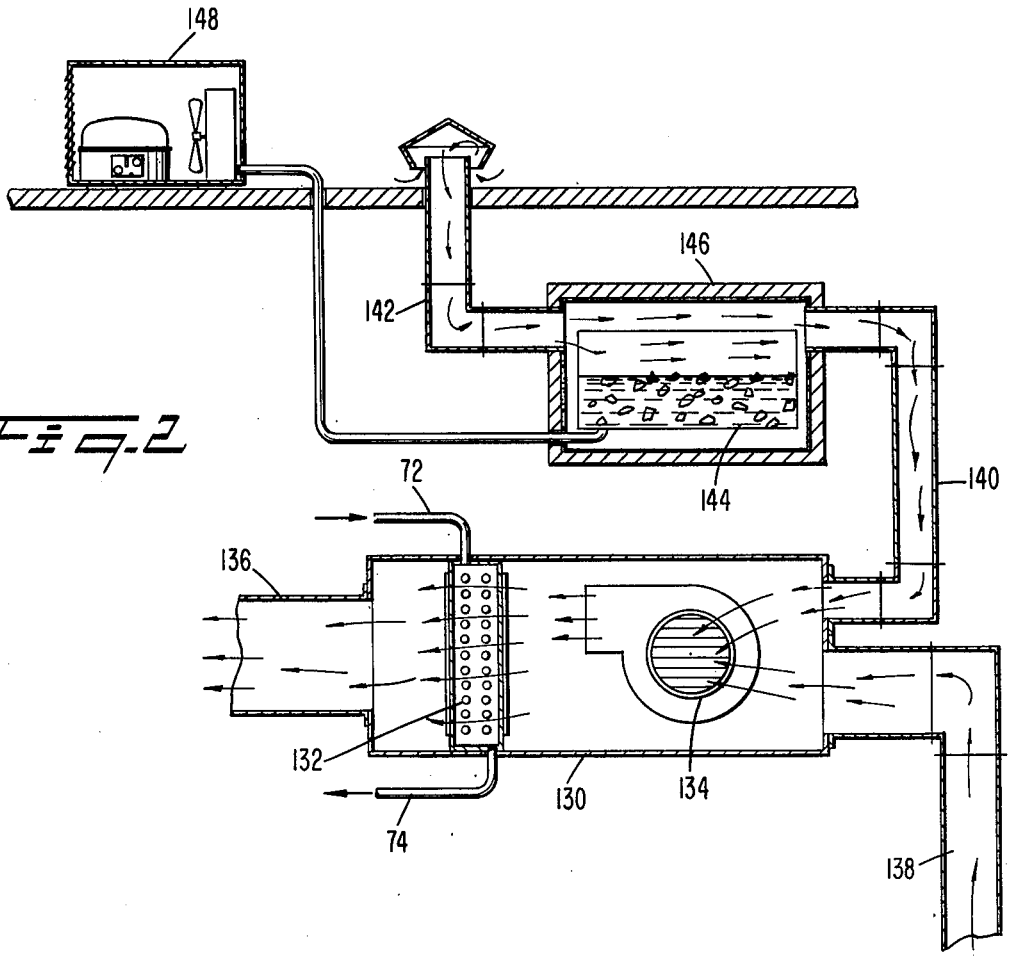
FIG. 2 is a detailed view of an air conditioning unit utilizing cold water from the icebank system to cool the ambient air in the supermarket.

Referring to FIG. 2, a preferred embodiment of an air conditioning unit which may be incorporated in the icebank system includes a housing 130 enclosing a heat exchanger 132 and a blower unit 134. Heat exchanger 132 is coupled to the main water supply conduit 32 via inlet line 72 for receiving cold water from the icebank storage tank and to the return conduit 36 via outlet line 74 for returning the spent water to the tank. Blower unit 134 communicates with the ambient air in the supermarket via an air outlet duct 136 and a return duct 138 to pass the air over heat exchanger 132 to be cooled. An inlet duct 140 supplies make-up air to the return side of housing 130 and blower unit 134 from a fresh air inlet 142 in communication with the atmosphere outside of the supermarket. The fresh make-up air entering inlet 142 is passed over a heat exchange unit 144, e.g., an ice storage tank, located within an insulated enclosure 146 and cooled by a remote compressor/condenser unit 148 located outside the supermarket. As a result, the make-up air is pre-cooled and dehumidified before it is mixed with the ambient air in blower unit 134 to control the humidity in the supermarket.

Figure 3:
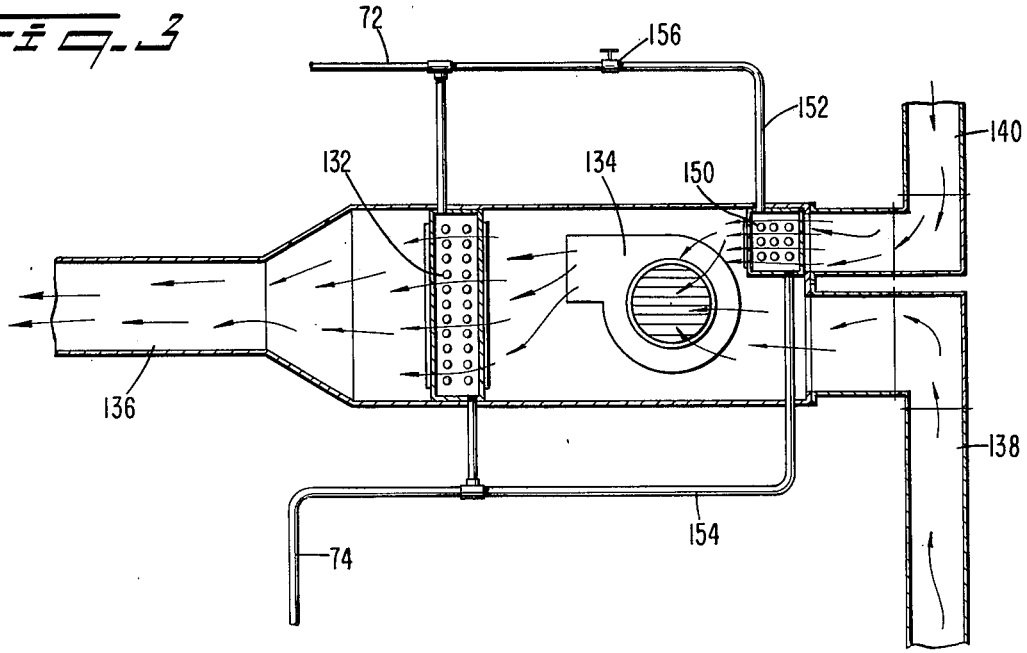
FIG. 3 illustrates an alternative air conditioning unit which utilizes cold water from the icebank system to cool both the ambient air and the make-up air supplied to the supermarket.

In the air conditioning unit shown in FIG. 3, a heat exchanger 150 coupled to the main water conduit is located at the entrance of inlet duct 140 to housing 130. Heat exchanger 150 is coupled to inlet and outlet lines 72 and 74 via water feed lines 152 and 154, respectively, to receive cold water from the main water supply conduit 32 and to feed the spent water to the return conduit 36. A control valve 156 is provided in water feed line 152 to selectively control the flow of cold water to heat exchanger 150. Make-up air supplied to the air conditioning unit via inlet duct 140 is pre-cooled and dehumidified by heat exchanger 150 prior to its mixture with the ambient air in blower 134 to control the humidity in the supermarket.

In the operation of the icebank system, mechanical icemaker unit 22 is operated to produce ice at its ice forming head 24 which drops into the cold water in icebank storage tank 20. Preferably, icemaker unit 22 is operated at off-peak hours to economically build up a supply of ice at times when the cost of electrical power is lowest. Alternatively, an immersion type icemaking unit (not shown) may be employed to produce ice directly in the cold water in icebank storage tank 20. If the outdoor temperature is below freezing, pump 26 of the brine cooling circuit may be activated to circulate brine through heat exchanger 28 to produce additional ice at icemaking head 30 which drops into icebank storage tank 20. The brine cooling circuit may also incorporate an immersion type ice forming device.

When it is desired to use the supply of ice stored in tank 20 for cooling purposes, main water pump 34 is actuated to circulate cold water at approximately 32° F. from the storage tank through main water supply conduit 32 and return conduit 36. The cooling unit in each produce area includes a tap-in connection to main water supply conduit 32 and a separate pump which is selectively activated to pump cold water from the main water supply conduit through the heat exchanger in the produce area. For example, fresh produce case 40 is cooled by actuating pump 52 to supply cold water via inlet line 44 to heat exchanger 42. The spent water is conveyed from heat exchanger 42 via outlet line 46 to return conduit 36. Similarly, dairy produce case 54 is cooled by actuating pump 66 to supply cold water via inlet line 58 to heat exchanger 56. The spent water from heat exchanger 56 is conveyed via outlet line 60 to return conduit 36. To cool preparation room or beverage case 84, pump 96 is actuated to supply cold water via input line 88 to heat exchanger 86 and fan 98 is rotated to circulate the air therein through the heat exchanger. The spent water from heat exchanger 86 is conveyed via output line 90 to return conduit 36.

The water returning to icebank storage tank 20 via return conduit 36 is at a higher temperature, e.g., between 40° F. and 50° F., than the 32° F. water in main water supply conduit 32. In any case, the water in return conduit 36 is sufficiently cold to maintain a low condensing temperature in refrigeration unit 100. Pump 114 is actuated to supply cold water from return conduit 36 via input line 106 to water jacket 104 which surrounds condenser 102. The cold water flows through water jacket 104 over condenser 102 to cool the refrigerant within the condenser. The spent water is returned via outlet line 108 to return conduit 36. When the outdoor temperature is sufficiently low, e.g., 50° F. or lower, valve 122 may be operated to disconnect condenser 102 and connect outdoor condenser 120 into the refrigeration circuit. The outdoor condenser allows the refrigeration circuit to utilize the cold air outside the supermarket to cool the refrigerant.

To actuate air conditioning unit 70, pump 80 is operated to supply cold water via inlet line 72 to the heat exchanger within the air conditioning unit. In the embodiment of FIG. 2, the cold water is supplied to heat exchanger 132 to cool the air circulated therethrough by blower 134. Ambient air from the supermarket is supplied to blower 134 via return duct 138 while make-up air is supplied from outside the supermarket via inlet duct 140. The make-up air is precooled and dehumidified by heat exchanger 144 which receives refrigerant from remote compressor 146. The make-up air and ambient air are mixed in blower 134 and passed through heat exchanger 132 for further cooling. The pre-cooled and dried make-up air serves to control the humidity within the supermarket.

In the embodiment of FIG. 3, make-up air supplied to inlet 140 is passed through heat exchanger 150 which receives cold water from the main water conduit. Otherwise, the operation is substantially the same as the embodiment of FIG. 2 described above. Control valve 156 permits the cold water flow to heat exchanger 150 to be shut off when the moisture content of the fresh make-up air is sufficient to provide the necessary humidity control without dehumidification of the make-up air.

In conclusion, the icebank system of this invention provides an efficient and economical system which is capable of handling large-scale refrigerating and cooling requirements such as encountered in supermarkets. The icebank system is especially advantageous because it allows a supply of ice to be built up in off-peak hours when the cost of electrical power is lowest for later consumption in normal business hours by circulating cold water to the various areas where refrigeration and cooling are required. The icebank system is also adapted to take advantage of low outdoor temperatures in cold climates to assist in producing ice and handling the refrigeration and cooling requirements in the supermarket.

Icebank refrigeration has other advantages when applied to certain types of refrigerating equipment. Such advantages include:

(1) When applied to an air conditioning system, it provides steady state temperature of the cooling medium and thereby produces better controlled cooling effect.

(2) The steady state conditions produce the lowest practical cooling temperature that results in the ability to work more effectively on the latent load of a building.

(3) When applied to refrigerators which operate at or near 40° F., the cooling is accomplished without having to apply the work of freezing the moisture from the air on the heat exchange surface, thereby saving that work. This has the additional advantage that since frost does not occur on a coil, defrosting is not required. Further, the steady state conditions which are thereby produced in the refrigerator are then most complimentary to the preservation of certain types of product like produce.

(4) The capability of using chilled water for the purpose of condensing the refrigerant on the low temperature systems makes it possible to annually utilize the lowest possible condensing temperature by the chilled water in the summer time and directly by ambient in the winter time. This is possible in those climates that have such atmospheric temperature as to permit the condensing temperature to be maintained annually at approximately 45°–50° F. or lower.

While a specific embodiment of the invention has been shown and described in detail, it will be understood that the invention may be modified without departing from the spirit of the inventive principles as set forth in the appended claims.

What is claimed is:

1. An icebank refrigerating and air conditioning system for use in a commercial establishment having a display area containing a plurality of refrigerated storage and display cases for storing and displaying produce, said establishment having a forced air circulating system for circulating air into and through the display area by means of ducts, said icebank refrigerating and air conditioning system comprising the combination of:

means for producing a supply of ice;

an icebank storage tank for storing said ice;

means, including a main conduit, for circulating cold water from said icebank storage tank to said display area and said forced air circulating system and for returning said water to said icebank storage tank;

display case heat exchange means associated with said produce display cases for cooling said cases;

means, including first branch conduit means and first pump means, for selectively coupling said heat exchange means to said main conduit means for selectively circulating cold water from said icebank storage tank through said display case heat exchange means and for returning said water to said storage tank downstream of said display case heat exchange means;

circulation system heat exchange means associated with said forced air circulating system for cooling ambient air flowing through said ducts into said display area; and means, including further branch conduit means and further pump means, for selectively coupling said circulation system heat exchange means to said main conduit means for circulating cold water from said icebank storage tank through said circulation system heat exchange means and for returning said water to said storage tank downstream of said circulation system heat exchange means.

2. The icebank system of claim 1, which includes:

a refrigeration unit including a condenser through which a refrigerant is circulated; and means for conveying the cold water from said main conduit across said condenser to maintain a low condensing temperature and cool the refrigerant.

3. The icebank system of claim 2, wherein:

said refrigeration unit includes a supplementary outdoor condenser through which the refrigerant is circulated when the outdoor temperature is sufficiently low to maintain a low condensing temperature and cool the refrigerant.

4. The icebank system of claim 1, wherein said ice producing means comprises:

a mechanical icemaker for building and depositing the supply of ice into said icebank storage tank.

5. The icebank system of claim 1, wherein said ice producing means includes:

a cooling circuit including an outdoor heat exchanger through which a cooling fluid is circulated with the outdoor temperature below freezing to build and deposit the ice in said icebank storage tank.

6. An icebank refrigerating and air conditioning system for use in a commercial establishment having a display area containing a plurality of refrigerated storage and display cases for storing and displaying produce, said establishment having a forced air circulating system for circulating air into and through the display area by means of ducts, said icebank refrigerating and air conditioning system comprising the combination of:

means for producing a supply of ice;

an icebank storage tank for storing said ice;

means for circulating cold water from said icebank storage tank to said display area and said forced air circulating system and for returning said water to said icebank storage tank, said cold water circulating means including a main water supply conduit extending from said icebank storage tank to said produce areas, main pump means for pumping cold water from said icebank storage tank through said main water supply conduit, a tap-in connection at each produce area for coupling said main water supply conduit to said heat exchange means in said produce area, and separate supplemental pump means at each produce area for pumping the cold water from said main water supply conduit through said heat exchange means;

display case heat exchange means associated with said produce display cases for cooling said cases;

means, including said supplemental pump means, for selectively coupling said heat exchange means to said main conduit means for selectively circulating cold water from said icebank storage tank through said display case heat exchange means and for returning said water to said storage tank downstream of said display case heat exchange means;

circulation system heat exchange means associated with said forced air circulating system for cooling ambient air flowing through said ducts into said display area; and means for selectively coupling said circulation system heat exchange means to said main conduit means for circulating cold water from said icebank storage tank through said circulation system heat exchange means and for returning said water to said storage tank downstream of said circulation system heat exchange means.

7. The icebank system of claim 6, which includes:

a return conduit coupled to each heat exchange means and to said icebank storage tank for returning spent water from said heat exchange means to said icebank storage tank.

8. The icebank system of claim 7, which includes:

a refrigeration unit including a condenser through which a refrigerant is circulated; and means coupled to said return conduit for conveying spent water therefrom across said condenser to maintain a low condensing temperature and cool the refrigerant.

9. The icebank system of claim 1 or 6, wherein said air cooling means comprises:

a first heat exchanger coupled to said water circulating means for receiving cold water from said icebank storage tank;

a blower for passing air over said first heat exchanger to be cooled;

an air outlet and a return located on opposite sides of said blower providing communication with the ambient air in the supermarket;

means for supplying precooled make-up air to the return side of said blower to mix with the ambient air and control the humidity in the supermarket.

10. The icebank system of claim 9, wherein said make-up air supplying means includes:

a second heat exchanger coupled to said water circulating means for receiving cold water from said icebank storage tank to cool said make-up air prior to its mixture with the ambient air.

* * * * *